United States Patent [19]

Flöter

[11] 4,349,331

[45] Sep. 14, 1982

[54] FURNACE INSTALLATION INCLUDING FUEL MILLING AND BURNT PRODUCT COOLING AND METHOD OF OPERATING SAME

[75] Inventor: Hans-Joachim Flöter, Hamburg, Fed. Rep. of Germany

[73] Assignee: Claudius Peters AG, Fed. Rep. of Germany

[21] Appl. No.: 186,263

[22] Filed: Sep. 11, 1980

[30] Foreign Application Priority Data

Sep. 21, 1979 [DE] Fed. Rep. of Germany ..... 2938144

[51] Int. Cl.[3] ..... F27B 15/00

[52] U.S. Cl. ..... 432/14; 432/106; 110/106; 110/347

[58] Field of Search ..... 432/105, 106, 103, 14; 110/106, 347

[56] References Cited

U.S. PATENT DOCUMENTS

| | | | |
|---|---|---|---|
| 2,259,967 | 10/1941 | Vogel-Jorgensen | 110/106 |
| 2,511,017 | 6/1950 | Sherban | 110/106 |
| 3,350,077 | 10/1967 | Christensen | 432/106 |
| 4,071,310 | 1/1978 | Ghesten | 432/106 |
| 4,120,645 | 10/1978 | Heian et al. | 432/106 |
| 4,168,951 | 9/1979 | Drugge | 432/106 |
| 4,236,886 | 12/1980 | Ansen et al. | 110/106 |

*Primary Examiner*—Henry C. Yuen

*Attorney, Agent, or Firm*—Eric P. Schellin

[57] ABSTRACT

A kiln system and method of operating the same, wherein a firing kiln is heated with pulverized fuel, and a crusher for the fuel and an air cooled cooling device for the fired material are provided, with at least a portion of the cooling air being supplied to the firing kiln as secondary air after passing through the cooling device, and the pulverized fuel being pneumatically taken from the crusher to a separator, from which the greatest portion of the pulverized fuel is supplied to the burner and from which the conveying air containing a small portion of the pulverized fuel is fed to the cooling device as cooling air.

8 Claims, 1 Drawing Figure

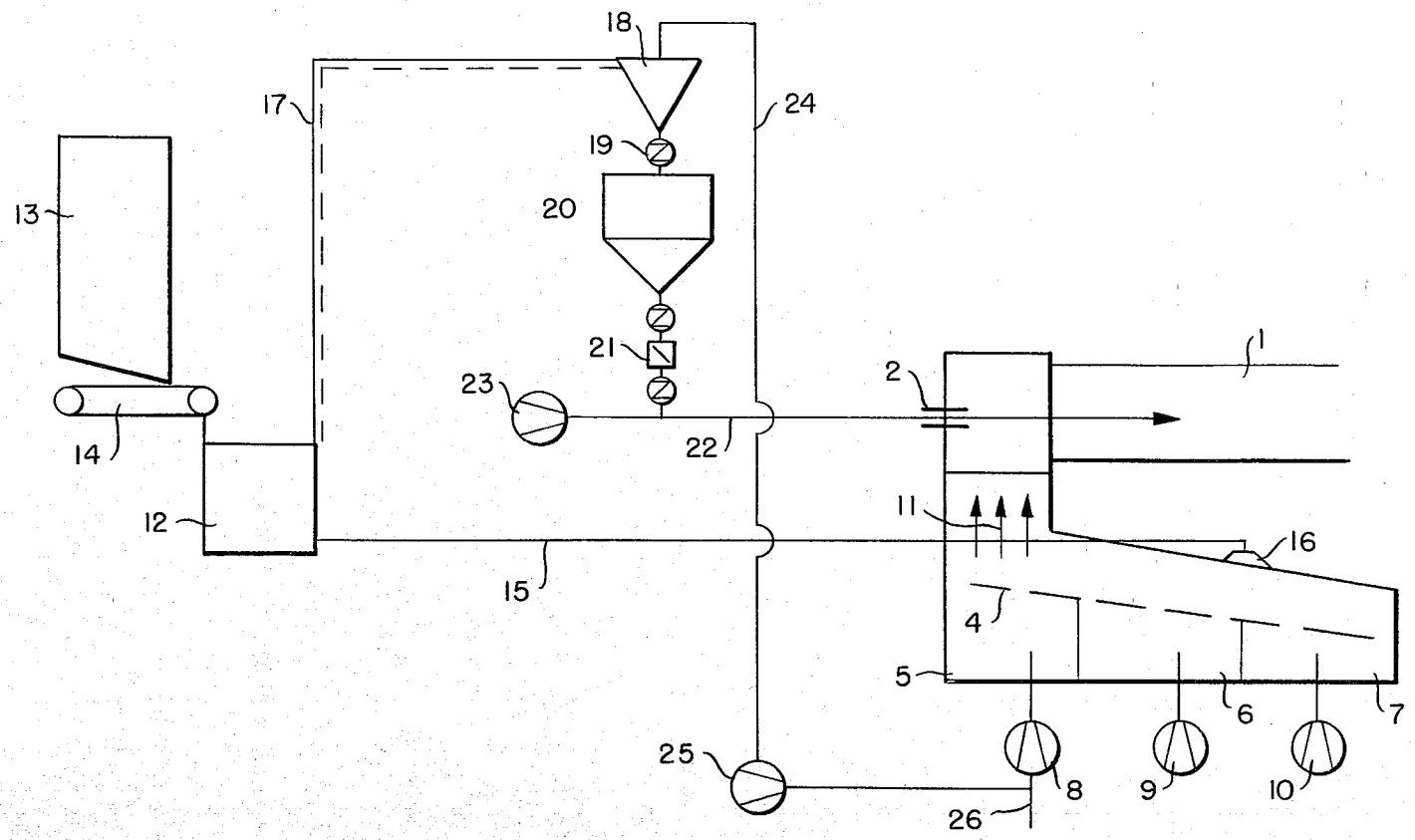
1
2
4
5
6
7
8
9
10
11
12
13
14
15
16
17
18
19
20
21
22
23
24
25
26

FURNACE INSTALLATION INCLUDING FUEL MILLING AND BURNT PRODUCT COOLING AND METHOD OF OPERATING SAME

BACKGROUND OF THE INVENTION

1. Field of the Invention

The invention relates to a method of operating a kiln system consisting of a firing kiln heated with pulverized fuel, an air cooled cooling device for the fired material and a crusher. The invention further relates to such a kiln system. It is especially intended for the coal dust firing of rotary kilns, such as those employed for the manufacture of cement clinker, fired lime, sintered dolomite and sintered ore. In this process, at least part of the cooling air is led to the firing kiln as secondary air after it flows through the cooling device. In addition, the pulverized fuel from the crusher is pneumatically conveyed to a separator, from where, on the one hand, the greatest portion of the pulverized fuel is drawn to the burner, and on the other hand, the conveying air is drawn off together with a small, unseparated portion of the pulverized fuel.

2. Prior Art

It is known to operate this type of system with a so-called blow in crusher. This means that the pulverized fuel, together with the conveying air which carries it out of the crusher, is led directly to the burner of the firing kiln. The conveying air is thus the primary air. Because the quantity of the conveying air must be determined with regard to its conveying function, this air quantity is much greater than the desired quantity of primary air. The latter should namely be held as small as possible with regard to flame formation, so that for reasons of heat economy the greatest possible proportion of the total air can be supplied from the highly heated secondary air. In the conventionally designed systems the primary air proportion in this respect is more than 18% of the total air, while a primary air proportion of approximately 8% would be desirable. Furthermore, the conventional method has the disadvantage that the conveying air, depending on the water content of the fuel, can contain a large amount of moisture, which lowers the absolute oxygen content. With regard to flame formation, however, a high oxygen content in the primary air is desirable.

In the so-called indirect blow-in method, which has become known through open prior use, the pulverized fuel is led with the conveying air into a separator. A portion of the dust-laden conveying air drawn from the separator is circulated back into the crusher, while another portion is used as the primary air and to convey the pulverized fuel to the burner. The primary air quantity is indeed decreased by this method and the heat economy is improved. Simultaneously, however, the relative moisture content of the primary air increases, because the entire moisture from the fuel is taken exclusively with the primary air out of the air circulatory system of the crusher. Furthermore, the absolute primary air quantity cannot be sufficiently lowered with regard to the drawn off quantity of moisture as would be desirable for heat economy.

In a third conventional method with a central crushing apparatus the conveying air is released to the atmosphere after the fuel dust has been separated out in filters. The selection of type and quantity of the primary air thus becomes independent of the conveying air. However, on the one hand this had disadvantages in heat economy, since the conveying air is generally heated to assist its drying function, and on the other hand filter systems cause increased danger of smoldering fire and explosion.

SUMMARY OF THE INVENTION

The object of the invention, therefore, is to create a kiln system and a method of operating the same, wherein a firing kiln is heated with an air cooled cooling device for the fuel, and at least a portion of the cooling air fed to the firing kiln as secondary air, in which the primary air is independent of the fuel conveying air and yet no filters are necessary.

The solution according to the invention provides that the conveying air containing the pulverized fuel is led or can be led to the cooling device as cooling air.

Since the conveying air is employed as cooling air and thereby as secondary air, the primary air source and quantity can be selected as desired. A low primary air ratio can therefore be chosen from a source with a high oxygen content. Removing the dust from the fuel conveying air becomes unnecessary, because the fuel contained therein is burned in the cooling device, or at the latest in the kiln. In this regard the conveying air is particularly effective as cooling air because of its water content. The heat contained in the conveying air is completely used in the operation of the kiln.

It is effective for the cooling device to be formed as a direct cooler, whereby the conveying air is preferably led to a first, hot section which is separate from subsequent sections. In particular, this cooling device is a grate cooler.

This concept is surprising inasmuch as it must be remembered that the fuel still contained in the conveying air is burned in the cooling device, thus causing an increase in temperature, which counteracts the cooling effect. It has been shown, however, that there is practically no decrease of the cooling effect, because the temperature increase resulting from the combustion of this fuel does not become effective until the fuel with its conveying air has passed most of the way through the cooling section. The temperature increase thus appears only in the hottest portion of the cooled material. The temperature increase begins immediately before leaving the cooling device, so that the cooling effect is not significantly affected. Instead, as a great advantage is the fact that the air heated an additional 100°-200° C. by the combustion of the coal dust enters the firing kiln as secondary air which is just that much hotter. In other words the quantity of fuel dust traveling with the conveying air does not increase the temperature in the cooling device, where it might act to a disadvantage, but in the kiln, where it is clearly desirable.

The conveying air for the crusher is effectively taken from the exhaust air of the cooling device, as is already known.

It can be effective to take the primary air of the burner from the exhaust air of the cooling device, in order to utilize the increased temperature of the exhaust air of the cooling device.

According to the invention an intermediate bin can be disposed in the path of conveyance between the separator and the burner, in order that the kiln operation is independent of the crusher operation.

BRIEF DESCRIPTION OF THE DRAWING

The invention will be described in greater detail below with reference to the drawing, wherein:

FIG. 1 shows an exemplary embodiment in a schematic repesentation.

DETAILED DESCRIPTION OF THE PREFERRED EMBODIMENT

At the head of the rotary kiln 1 is a burner 2 which is fired with coal dust. As it leaves the rotary kiln 1, the fired material falls onto the grate 4 of the grate cooler 3. The lower chamber of the grate cooler is divided into sections 5, 6 and 7, which are supplied with cooling air by special blowers 8, 9 and 10. After the air has passed through the grate 4 and the bed of material to be cooled lying thereon, a portion thereof, preferably the portion from the first section 5, is led into the kiln 1 as heated secondary air in the sense of the arrows 11.

The coal crusher 12 receives the coal, still moist from the mine, from the raw coal bin 13 by way of suitable dosing and, if necessary, weighing devices 14. Conveying and drying air is supplied to the coal crusher 12 through a duct 15, which leaves the upper chamber of the cooling device 3 at 16. The crusher system is subject to the excessive pressure prevailing in the cooling device. The sufficiently fine, dry coal dust carried out of the crusher with the conveying air travels through duct 17 and into the separator 18, where the coal dust is separated as far as possible with the degree of effectiveness of this separator. The greatest portion of the coal dust is separated and travels through a channeling device 19 into the coal dust bin 20. From there the firing-ready dust is delivered in a suitable manner by channeling and weighing devices 21 to the blower duct 22 of the primary air blower 23 and is blown with the desired quantity of primary air into the burner 2, or into the firing kiln 1. The delivery rate of the primary blower 14 can be held down to allow the coal dust channeled into the duct 22 to be conveyed directly into the rotary kiln at the optional speed. According to experience, this is possible with a primary air ratio of 6–8% of the total combustion air.

From the separator 18 the conveying air containing 3–10% (generally 5–7%) coal dust is led through duct 24 and blowers 25 and 8 to the first section 5 of the grate cooler and thereby arrives in the hottest portion of the cooling bed. The separation of the conveying air supply to this first section from the subsequent sections of the cooling device can be assisted by the walls shown beneath the grate in the drawing, but they are not absolutely necessary for this purpose.

The cooling air blower 8 is formed such that it can also aspirate from the atmosphere through duct 26. The ratio between the aspirated quantity of conveying air to the quantity of fresh air can be adjustable, in order to take into account the current operating conditions. On an average one can figure that approximately 25% of the total blown-in air will be supplied from the conveying air.

The conveying air is delivered at approximately 100° C. As a consequence of the admixture of the atmospheric air the temperature entering the cooling device is still lower. The temperature increase of the cooling air caused by the use of the conveying air from the crusher thus has practically no effect in comparison with the high temperature of the material in the first cooler section (more than 1200° C.).

The conveyed coal dust either burns in the cooling bed of the upper, hottest zone of the cooling grate, or only a gasification takes place, because the flow speed of the cooling air is relatively high, whereby the final combustion occurs in the kiln. When the combustion of the coal dust occurs in the hot clinker bed, most of the released heat is transferred to the cooling air and thereby to the secondary air. In heat-economically well designed firing and sintering systems the secondary air leaving the grate cooler reaches a temperature near 800° C. Under the assumption that all of the coal dust burns early in the cooling device, the secondary air temperature is increased by approximately 150° C. For the subsequent combustion in the rotary kiln the conveyed coal dust has already experienced preliminary combustion, whereby the heat released thereby benefits the process in the rotary kiln. The extremely highly heated secondary air is extraordinarily welcome for reasons of firing technology. The invention makes it possible to transform the conveying air from the coal crusher, which otherwise disadvantageously appears entirely or partially as low temperature primary air, into high temperature secondary air.

What we claim as new and desire to secure by U.S. Letters Patent is:

1. In a method of operating a kiln system including a firing kiln heated with pulverized fuel, an air cooled cooling device for the fired material and a crusher for the fuel, wherein at least a portion of the cooling air is led to the firing kiln as secondary air after passing through the cooling device and wherein the pulverized fuel is pneumatically taken via conveying air from the exhaust air of the cooling device from the crusher to a separator from where the greatest portion of the pulverized fuel is led to a burner before entering the kiln and, also the conveying air is drawn off together with a small portion of the pulverized fuel, the improvement comprising the step of supplying the conveying air containing the pulverized fuel to the cooling device as cooling air.

2. A method according to claim 1, wherein the conveying air is led to the hottest section of the cooling device, which is formed as a direct cooler.

3. In a kiln system including a firing kiln heated by pulverized fuel burner, an air cooled cooling device for the fired material, conveying means for conveying cooling air to the cooling device, conveying means for conveying exhaust air from the cooling device to the firing kiln as secondary air, a fuel crusher, a conveying means for conveying exhaust air from the cooling device to the crusher, means for pneumatically conveying the pulverized fuel from the crusher to a separator, and means for conveying most of the pulverized fuel from the separator to a burner before entering the kiln, the improvement comprising means for supplying the conveying air together with a small portion of the pulverized fuel from the separator to the cooling device as cooling air.

4. A kiln system according to claim 3, wherein the cooling device is formed as a direct cooler.

5. A kiln system according to claim 4, wherein a first hot section of the cooling device is separate from subsequent sections, and the cooling air conveying means includes means for conveying the fuel.

6. A kiln system according to one of claims 4 or 5, wherein the cooling device is a grater cooler.

7. A kiln system according to one of claims 3, 4 or 5, wherein conveying means takes primary air from the exhaust air of the cooling device.

8. A kiln system according to one of claims 3, 4 or 5, wherein an intermediate bin is provided between the separator and the burner in the path of the fuel.

* * * * *